United States Patent [19]

Maeda et al.

[11] 4,109,663

[45] Aug. 29, 1978

[54] TOBACCO PRODUCT CONTAINING A THERMO-GELABLE β-1,3-GLUCAN-TYPE POLYSACCHARIDE

[75] Inventors: Kazuo Maeda, Yokohama; Katuichi Noguchi, Tokyo; Masuo Kawabata, Yokohama; Shigehiko Sato, Tokyo; Yukio Sato, Ibaraki, all of Japan

[73] Assignee: Takeda Chemical Industries, Ltd., Japan

[21] Appl. No.: 620,351

[22] Filed: Oct. 7, 1975

[30] Foreign Application Priority Data

| | | | |
|---|---|---|---|
| Oct. 17, 1974 | [JP] | Japan | 49-120189 |
| Apr. 30, 1975 | [JP] | Japan | 50-52863 |
| Jul. 14, 1975 | [ID] | Indonesia | 5332 |

[51] Int. Cl.[2] ..... A24D 1/18; A24B 3/14

[52] U.S. Cl. ..... 131/2; 131/17 R; 131/17 AC; 131/140 R; 131/140 C

[58] Field of Search ..... 131/2, 17, 140 R, 15, 131/140 C; 536/1; 426/97

[56] References Cited

U.S. PATENT DOCUMENTS

| | | | |
|---|---|---|---|
| 3,125,098 | 3/1964 | Osborne | 131/17 AC |
| 3,754,925 | 8/1973 | Kimura et al. | 426/92 |
| 3,822,250 | 7/1974 | Kimura et al. | 536/1 |
| 4,018,233 | 4/1977 | Miyake | 131/17 AC |

OTHER PUBLICATIONS

Tobacco and Tobacco Smoke by Wynder & Hoffman, Academic Press, 1967, pp. 330 & 350 cited.

*Primary Examiner*—Robert W. Michell
*Assistant Examiner*—V. Millin
*Attorney, Agent, or Firm*—Wenderoth, Lind & Ponack

[57] ABSTRACT

A smoking tobacco product, which is produced by incorporating in smoking material a thermo-gelable β-1,3-glucan-type polysaccharide, either as the sole smoking material or as its partial replacement, has improved smoking characteristics such as flavor, taste and irritability, and its smoking material has improved physical properties such as thickness, wet-proof qualities, tensile strength, elongation and filling capacity.

52 Claims, No Drawings

TOBACCO PRODUCT CONTAINING A THERMO-GELABLE β-1,3-GLUCAN-TYPE POLYSACCHARIDE

This invention relates to a tobacco product which comprises incorporating in smoking material a thermo-gelable β-1,3-glucan-type polysaccharide, either as the sole smoking material or as its partial replacement.

It is an object of this invention to provide a tobacco product with improved smoking characteristics.

Another object is to provide an unusually superior binding agent for reconstituted tobacco, synthetic tobacco, etc. Still another object of this invention is to provide a tobacco substitute with less irritative or less unpleasant odor and with improved organoleptic properties and to produce a tobacco substitute having better physical properties and improved processing characters relative to the known tobacco substitutes.

Further, another object is to improve physical properties of tobacco leaves and thereby to effect savings in tobacco leaves.

Other objects will become clear hereinafter as the disclosure proceeds.

In the context of this specification and the appended claims, the term "smoking material" means all kinds of smokable material including, among others, natural tobacco leaves such as burley, Turkish tobacco, Maryland tobacco, Virginia tobacco, flue-cured tobacco and the like, tobacco originated material such as reconstituted tobacco, homogenized tobacco, tissue culture tobacco, etc. and non-tobacco originated material intended to replace natural tobacco leaves with various vegetable leaves such as lettuce, cabbage leaves, etc., cellulose derivatives such as carboxymethylcellulose, methylcellulose, etc., starch derivatives such as carboxymethylstarch, carboxyethylstarch, etc., and so on. The term "smoking tobacco product" means all kinds of smokable products including, among others, cigarettes, cigars and cigarillos, fine cut tobacco, pipe tobacco and the like, which are made from said smoking material.

The "smoking tobacco substitute" means any material being used to substitute for natural tobacco leaves.

As additives for smoking material, there have been employed such casing sources as saccharide, e.g. sucrose, glucose, sorbitol, etc., and glycols, e.g. glycerin, ethylene glycol, propylene glycol, 1,3-butylene glycol, etc. and such flavorants as various essential oils.

The effects of casing sources are said to include improvements in smoking characteristics and in physical properties such as fragility, tensile strength, moisture retention, yield, etc. These casing sources still have many behaviors to be further improved.

Depending upon the variety of tobacco, there are employed, in addition to said additives, binders or spreader such as galactomannan gum, locust bean gum, carboxymethylcellulose, hydroxyethylcellulose, carboxymethylstarch, sodium alginate, sodium pectinate, etc., either singly or as a suitable mixture.

These additives are also used in conjunction with wet-proof agents such as glyoxal, dialdehyde starch and so on. However, the use of these additives, especially those binders or spreader, wet-proof agents, etc. which are conventionally employed, has been limited to the necessary minimum because they are less desirable than tobacco leaves in terms of flavor and other smoking characteristics. Furthermore, so far, tobacco products in various forms, e.g. cigarettes, cigars and fine cut tobacco, have all been produced employing naturally cultivated tobacco leaves as the smoking material and processing them by various means. Recently, however, in view of the change of smokers' liking or of the smokers' hygiene, the market for tobacco products with light taste grows. Complying with the demand, the development of tobacco substitutes which may be substituted for all or a part of natural tobacco leaves is under rapid progress.

There has been known, as the smoking material for tobacco substitute (burning material), cellulose derivatives, e.g. carboxymethylcellulose, carboxyethylcellulose, hydroxyethylcellulose, carboxymethylhydroxyethylcellulose, methylcellulose, ethylcellulose and hydroxypropylcellulose, starch derivatives, e.g. starch, carboxymethylstarch and carboxyethylstarch; and so on.

These burning materials still have some properties to be improved from the viewpoints of their taste on smoking and burning behavior. Thus, it has been expected among industries of manufacturing tobacco substitute that a novel burning material be provided for the substitute for known burning materials.

The present inventors made an intensive research into the flavor and taste, physical properties, processability and other properties of tobacco product and found that a thermo-gelable β-1,3-glucan-type polysaccharide (hereinafter referred to as the polysaccharide), which means a thermally gelable polysaccharide composed predominantly of β-1,3-glycosidic units, has an excellent binding action as well as properties to improve the smoking characteristics, e.g. flavor, taste, irritability, etc., of tobacco product and to improve the physical properties of smoking material, for example its firmness, tensile strength, elongation, filling capacity, wet-proof qualities, flexibility, yield etc. and has desirable burning behaviors to give less tar and less hazardous substances, further that the polysaccharide can be used as tobacco substitute sheet without employing any other binding agent and wet-proof agent. This invention was completed on the basis of these findings.

As the polysaccharide that is to be employed according to this invention, there are known those of vegetable origin, microorganism origin and so on. Although these are all advantageously employable for the method of this invention, those originated from microorganisms are rather easily available ones among them. For instance, there may be mentioned the polysaccharide elaborated by microorganisms belonging to the genus Alcaligenes and the polysaccharide produced by microorganisms belonging to the genus Agrobacterium. More particularly, there may be mentioned the polysaccharide produced by *Alcaligenes faecalis var. myxogenes* 10C3K (Agricultural Biological Chemistry Vol. 30, pages 196 et seq. (1966) by Harada et al.; hereinafter referred to as polysaccharide A), the polysaccharide produced by the mutant NTK-u (IFO-13140, ATCC 21680) of *Alcaligenes faecalis var. myxogenes* 10C3K (U.S. Pat. No. 3,754,925, U.S. Pat. No. 3,822,250) (hereinafter referred to as polysaccharide B), the polysaccharide produced by *Agrobacterium radiobacter* (IFO-13127, ATCC 6466) or its mutant U-19 (IFO-13126, ATCC 21679) (U.S. Pat. Nos. 3,754,925, 3,822,250) (hereinafter referred to as polysaccharide C) and pachyman being a main ingredient of *Poria cocos* (Agr. Biol. Chem. Vol. 32, No. 10, P. 1261 (1968)), and the like.

The polysaccharide may be used in either purified or crude preparation. As the crude preparation, any of crude materials, whether wet or dried, in various stages of the purification process of the polysaccharide from the culture broth may be used, as far as it contains at least about 80 weight percent of the polysaccharide on dry basis and, when it is gelled or incorporated as it is, it contains at least 0.5 weight percent of the polysaccharide relative to its weight. Thus, for example, a cell-containing cultured broth, a cell-free filtrate or their concentrate is also utilized.

The characteristics and advantages of the polysaccharide as it is used as additives to smoking material include the following.

An advantage is that the smoking characteristics are improved. While addition of the polysaccharide to the conventional smoking material improves their smoking characteristics, the use of the polysaccharide in lieu of the conventional additive or additives results in considerably ameliorated smoking characteristics. This is presumably because the polysaccharide yields less offensive odors and less irritant pyrolyzates upon pyrolysis and combustion and, in addition, the aforementioned ameliorated physical properties are apparently responsible, to a certain extent, for the improvements in smoking characteristics.

Another advantage is that the reductions in nicotine and tar contents are accomplished. These results are of necessity accomplished, partly because since the tobacco shreds in which the polysaccharide has been incorporated have an increased filling capacity, this capacity being further increased by the co-use of a puffing agent such as sodium bicarbonate and ammonium carbonate with the polysaccharide, and other improved physical characteristics, such a product is superior to ordinary tobacco shreds in firmness, assuming they are equal in packaged amount, with the result that if a tobacco product of a given firmness is the goal, the polysaccharide is instrumental in reducing the required amount of tobacco shreds, and partly because the polysaccharide does not contain nicotine and produces a considerably less amount of tars than does the tobacco shreds.

Furthermore, the polysaccharide is an excellent binder providing better binding and smoking characteristics than do the hitherto-known binders such as galactomannan gum, locust bean gum, carboxymethylcellulose, carboxymethylstarch, sodium alginate, sodium pectinate and so on.

Currently carboxymethylcellulose is commonly employed but this additive is undesirable in that it imparts adhesivity to tobacco sheet under the wet condition in the production process as well as its unpleasant burning flavor.

In contrast, the polysaccharide is advantageous, process-wise, in that it gives insoluble and unadhesive tobacco sheet in water, which results in making the production process easy and increasing yield of the tobacco product. In addition, with the polysaccharide, the existing tobacco-manufacturing equipment can be utilized without modifications. When any of the aforementioned known binders is employed, it is necessary, for instance, to use a wet-proof agent such as glyoxal or dialdehyde starch in combination with the binder. However, because the polysaccharide has both excellent binding and wet-proof properties, a wet-proof agent are not necessarily required. Although the polysaccharide may be used together with a suitable amount of any known binder, even in this case, use of no wet-proof agent is necessarily required. Lastly, if the surface of a cigar wrapper and of paper, which is a material used in the manufacture of cigarettes and the like, is treated with the polysaccharide, the surface texture is improved in smoothness and other qualities and, because of the resultant enhanced wet resistance, the dissipation of the odor, flavor and moisture from the stuffer or filler smoking material is prevented and, accordingly, the staining of the wrapper is inhibited so that general deteriorations in the quality of tobacco product are prevented. Furthermore, the excessive wetting of the tobacco product with saliva and the resultant discomfort of a smoker's lip touch are improved.

The method and stage of addition of the polysaccharide are unlimited for practical purposes.

As for the manner in which the polysaccharide is employed, the powdery polysaccharide as such may be employed or, alternatively, it may be previously caused to swell or made readily swellable.

The latter-mentioned condition is exemplified by a dispersion of the polysaccharide in water, aqueous alcohol, aqueous polyol, aqueous ammonia or the like, and a gelation product of the polysaccharide.

The dispersion is preferably in the concentration range of about 0.5 to 10 weight percent. The gelation product can be obtained for example, by preparing a dispersion containing 0.5 to 10 weight percent of the polysaccharide, heating the dispersion under stirring to about 55° to 78° centigrade and, then, promptly allowing it to stand and cool or, alternatively, heating and allowing to stand the aforesaid dispersion at a temperature of about 65° to about 200° C., preferably about 70° to about 150° C. Another alternative procedure comprises adding the polysaccharide to an aqueous solution of alkali, e.g. sodium hydroxide, potassium hydroxide or sodium carbonate, of about 0.1N to about 3N and, then, neutralizing the dispersion or adding, for example, calcium hydroxide or calcium carbonate, thereto, followed by neutralization.

In these procedures, a porous gelation product can be obtained by adding to the polysaccharide a puffing agent such as sodium bicarbonate and ammonium carbonate.

The aforementioned gelation product can be processed by conventional manner into sheets or other optional shapes.

The sheet-like gelation product may be shredded into suitable size and to these shreds, further, may be added with various flavoring materials, or the polysaccharide to which the flavoring materials were previously added may be gelled.

The flavoring materials include any of those conventionally employable as the tobacco additive, i.e. extracts such as tobacco extract and licorice extract, menthol, organic acid esters, amino acids, proteins, essential oils, fruit flavors such as peach, walnut and cherry and so on.

While the amount of the flavoring materials to be thus employed depends upon such factors as uses, desired taste, etc., it is in general preferable to employ about 0.1 to about 10 percent based on the weight of the gelation product.

To the gelation product and the polysaccharide, further, may be added with a suitable amount of glow-promoting catalysts, materials to improve ash coherence and so on.

As glow-promoting catalysts for ensuring "fire-holding capacity", alkali metal compounds are preferred.

As material to improve the ash, salts of ammonia, alkali metals or alkaline earth metals can be used and of these salts of magnesium, calcium or ammonium are preferred.

The addition of the polysaccharide may be effected either directly or in any other manner, e.g. by spraying.

The polysaccharide may be added to smoking material before, during or after processing. For the manufacture of sheet tobacco, the polysaccharide may be added to a whole smoking material or, alternatively, a sheet-like gelation product of the polysaccharide may be jointed to the sheet tobacco smoking material. In the production of calus tobacco, the polysaccharide may be added before or after molding, or before or after drying and, then, the blending may be performed. The polysaccharide may also be added in the course of manufacture of pipe tobacco and cigars, or in such products. In the case of cigarettes, the polysaccharide may also be used as coated on the wrapping paper for use in the making of cigarettes or as incorporated in the adhesive for fastening the paper.

While the amount of the polysaccharide to be thus employed depends upon such factors as the type of tobacco products to be processed by the polysaccharide, uses, desired tastes, etc., it is in many cases preferable to employ 0.1 to 30 percent by weight of the polysaccharide based on the weight of tobacco leaves or about 0.05 to about 25 percent by weight of the polysaccharide based on the weight of smoking material. Particularly, it is in general preferable to employ about 0.1 to about 10 percent by weight of the polysaccharide for the purpose of the improvement of smoking characteristics, about 0.5 to about 15 percent by weight of the polysaccharide for the purpose of the improvement of physical properties and about 1 to about 30 percent by weight of the polysaccharide for the purpose of the improvement of binding action and other properties of reconstituted tobacco, synthetic tobacco and so on, which are in general mixed in other smoking material at the rate of about 25 percent by weight based on the weight of whole smoking material.

In case of the incorporation of wrapping leaves of cigars and wrapping papers of cigarettes, of tobacco filters, etc., it may be preferable to employ about 30 to 200 grams per square meter of the polysaccharide dispersion of about 0.5 to about 10 percent by weight, by means of coating, spraying, etc. Furthermore, a tobacco substitute is produced by employing burning regulator and the polysaccharide and is also used as a substitute for all or a part of smoking material.

The polysaccharide is employed as a substitute for all or a part of known burning materials. In this case, it is advisable to use from 30 to 100 percent of polysaccharide in terms of its purified material relative to the total amount of burning materials which may include the polysaccharide used for the burning material.

As the burning regulator, there may be employed nonburning and physiologically inactive inorganic compounds, e.g. oxide, hydroxide, carbonate, phosphate, sulfate, aluminate, silicate, aluminosilicate and so on of alkali metals such as sodium and potassium, alkaline earth metals such as calcium and magnesium, and other metals such as zinc, aluminium, iron, titanium and silicon. Further, there may be used natural inorganic compounds e.g. dolomite, bentonite, diatomaceous earth, magnecite, perlite, vermiculite and asbestos, and carbonaceous materials e.g. activated carbon.

So far, it has been known that, in the method for the preparation of tobacco substitutes employing burning material and burning regulator, the objective product can be obtained by shaping, into sheet, thread or the like, a mixture of materials containing burning material and burning regulator; or by making burning regulator adhere to a burning material shaped into such a proper form as sheet or the like. In the method for the production of this tobacco substitute, shaping of the burning material may be effected through availing the gelable behavior of the polysaccharide.

It may be possible to apply the manner of gelation of the polysaccharide per se which is described on page 8, to the means for the production of the tobacco substitute.

As examples of the practising features of this invention, there may be processes of (a) spreading an aqueous slurry containing the polysaccharide and a burning regulator on a plate with smooth surface, followed by heating to be dried up and to make a sheet, (b) adding to an alkaline aqueous slurry containing the polysaccharide and a burning regulator a water-soluble calcium salt, followed by shaping and then drying, (c) spreading an aqueous suspension containing the polysaccharide, so far known burning material and burning regulator on a plate with smooth surface, followed by heating to be dried up and to make a sheet, (d) making into sheet or thread wet powdery particles containing the polysaccharide, burning regulator and comparatively small amount of water by the use of an extruder or a roller, followed by drying up under heating, (e) shaping gel made from the polysaccharide together with an appropriate binder such as galactomannan gum, locust bean gum, carboxymethylcellulose, sodium arginate, sodium pectinate and so on, and (f) other suitable manners.

The tobacco substitutes shaped in sheet or thread form are shredded into suitable size and shape in accordance with their objects in use.

The incorporating ratio between the burning regulator and the combination of the burning material and the polysaccharide is, in the respective weight ratio, 90:10 to 10:90, and preferably 70:30 to 30:70. Further, to the tobacco substitute there may conveniently be added any of conveniently used additives such as perfumes, materials to improve ash coherence, tobacco powder, nicotine (usually used in the form of sulfate or organic acid salts), edible pigments and so on. As such perfumes, there may be tobacco extract, licorice extract, Saint John's Bread extract, Cacao extract, absolute honey wax, menthol, vanilla extract, organic acid esters, essential oils and so on. These additives may be added before or after shaping of the tobacco substitute of this invention. Thus, these may be added to the tobacco substitutes furnished. In the latter case, the perfumes or the like is preferably added in the form of a suitable solutions or dilutions in an organic solvents such as ethanol.

The characteristics of the tobacco substitutes thus obtained is firstly remarkably improved physical properties. Namely, the sheet tobacco substitute composed of the polysaccharide does not dissolve in water and gives a little adhesivity, but shows excellent binding property when gelled, so that the physical properties of the tobacco substitutes of this invention is remarkably improved in firmness, elongation, tensile strength, and so on in comparison with so far known burning materials. And, according to this invention, smoking characteristics is remarkably improved. This is easily understandable from the fact that there is a little bad smell and irritative pyrolyzates on burning or on pyrolyzing, and from the fact that there is keen relationship between the abovementioned improved physical properties and improved smoking characteristics.

The following experimental data and working examples are intended merely to illustrate presently preferred embodiments of the present invention and not to restrict the scope of this invention.

EXPERIMENT 1

1.5 g. of polysaccharide B was weighed into a round-bottomed flask of 100 ml. capacity, fitted with a condenser and pyrolyzed in a silicone bath maintained at 240°-280° C for 2 hours. The pyrolysate consisted of brownish tan powders, caramels and tarry components, giving off a caramel odor. There was substantially no irritant odor like that commonly encountered upon pyrolysis of cellulose, carboxymethylcellulose, galactomannan gum, carboxymethylcellulose, carboxymethylstarch and sodium alginate.

EXPERIMENT 2

2 g. of polysaccharide B was weighed out an a sufficient amount of deionized water was added to it to make 100 ml. The mixture was homogenized in a mixer for 5 minutes. The resulting suspension was transferred onto a glass plate 5 mm thick, subjected to degassing and heated at 100° C. for 5 hours to prepare a film. When ignited, the film burned with the production of a flame and the smoke arising from it upon extinguishing had an caramel-like odor. This was in contrast with the odor irritating to the nostrils characterized by the lack of caramel-like odor which was experienced with the smoke arising upon extingushing a burning cellulose, carboxymethylcellulose, galactomannan gum, carboxymethylstarch, or sodium alginate.

EXPERIMENT 3

The pyrolysate of the polysaccharide was analyzed with a pyrolytic gas chromatography. As controls, the pyrolysates of glucose, which is the monomeric unit of the polysaccharide, and cellulose, which is the principal polysaccharide occurring in tobacco leaves, were also analyzed.

The conditions under which these samples were pyrolyzed are as follows.

Pyrolyzer: Hitachi Model KP-1

Furnace temperature: 500° C.

Heating time: 20 seconds

The conditions of analysis of pyrolysates are as follows.

Gas chromatographic apparatus: Hitachi Model 063

Column: Dinonyl phthalate/Diasolid ® L(60-80 mesh)=30:100: 3 mm in dia. × 3 m.

Temperature of column: 8 minutes at 30° C.; thereafter, the temperature was increased to 80° C. at the rate of 2° C./min.

Carrier gas: Helium, 30 ml./min.

Detector: Hydrogen flame ionization detector

The peak areas of the chromatogram of each sample were computed by means of a digital integrater (Takeda Riken Model TR 2211). The result was expressed as a percentage of the individual peak area relative to the sum total of areas of various gas components. Of the unidentified components, $X_1$ with a large peak area is also shown.

These results are set forth in Table 1.

Table 1

| Pyrolysate | Sample | Percent of Pyrolyoates | | |
|---|---|---|---|---|
| | | Poly-saccharide B | Glucose | Cellulose |
| Acetaldehyde | | 7.6 | 8.1 | 15.0 |
| Methanol | | 0.2 | 1.8 | 0.4 |
| Isoprene | | 0.3 | 0.4 | 0.2 |
| Furan | | 2.2 | 1.9 | 4.0 |
| Propionaldehyde | | 1.2 | 1.4 | 2.1 |
| Acetone, Acrolein | | 10.7 | 10.1 | 19.9 |
| $X_1$ | | 10.7 | 10.3 | 9.0 |
| 2-Methylfuran | | 4.4 | 3.0 | 1.6 |
| n-Butylaldehyde | | 0.8 | 0.9 | 0.9 |
| Methyl ethyl ketone | | 4.4 | 3.3 | 6.9 |
| Diacetyl | | 3.7 | 3.7 | 4.7 |
| Benzene | | 1.0 | 1.7 | 1.4 |
| 2,5-Dimethylfuran | | 4.2 | 2.7 | 3.7 |
| Crotonaldehyde | | 2.3 | 2.9 | 4.0 |
| Toluene | | 8.9 | 13.2 | 2.8 |
| Methane, ethane and other hydrocarbons | | 37.4 | 34.6 | 23.4 |

It is apparent from Table 1 that, compared with cellulose, polysaccharide B can be said to be low in acetaldehyde, acetone and acrolein contents, and to be less irritating as to its pyrolysate. The results for polysaccharide A and polysaccharide C are substantially the same as the results obtained with polysaccharide B.

EXPERIMENT 4

Under the same conditions as those set forth in Experiment 3, there were obtained pyrograms of the polysaccharide and glucose over the pyrolytic temperature range of 200 to 500 degrees centigrade. The sum totals of peak areas are set forth in Table 2.

Table 2

| Temperature of pyrolysis (° C) | Peak areas | |
|---|---|---|
| | Polysaccharide B | Glucose |
| 200 | 0 | 2510 |
| 250 | 0 | 11450 |
| 300 | 25844 | 48439 |
| 400 | 43544 | 94319 |
| 500 | 96475 | 172826 |

Compared with glucose, the polysaccharide is high in the temperature of pyrolysis and low in gaseous components.

EXPERIMENT 5

A blend of tobacco leaf fines of 60 g. of flue-cured tobacco, 25 g. of Japanese domestic tobacco and 15 g. of burley tobacco, and flavored tobacco stems (winnower debris) were comminuted to sizes not exceeding 100 mesh. A sheet pulp was also flavored and disintegrated in a turbo-mill.

70 g. of the blended tobacco powder was mixed with the powdered stem (winnower debris), followed by the addition of 10% (on a dry basis) of the pulp fiber as a reinforcement. After thorough mixing, 5% each of sucrose and propylene glycol were added. Following the addition of 8% of polysaccharide B, a sufficient volume of water was added to the mixture so that the water content of the mixture was about 40%. The resulting wet powder was thoroughly homogenized and formed into a web on a press roll plant for tobacco sheet. The web was dried at 100° C. to obtain a reconstituted tobacco sheet with a moisture content of about 12%.

On the other hand, as controls, the polysaccharide B was replaced by (1) 4% of carboxymethylcellulose and 4% of glyoxal, (2) 8% of locust bean gum or (3) 4% of sodium alginate and 4% of glyoxal and the respective compositions were homogenized and processed in the same manner as above to prepare reconstituted tobacco samples.

Each of these samples was made into single-strand cigars and organoleptically tested twice by 10 panelists.

The total scores of two smoking tests are shown in Table 3.

Table 3

| Sample \ Smoking characteristics | Flavor | Taste | Irritability |
|---|---|---|---|
| Control (1) | 7 | 4 | 2 |
| Product of this invention | 13 | 16 | 18 |
| Control (2) | 5 | 3 | 1 |
| Product of this invention | 15 | 17 | 19 |
| Control (3) | 6 | 4 | 2 |
| Product of this invention | 14 | 16 | 18 |

The scores on flavor and taste, respectively, mean the number of smokers who judged that the corresponding product was better; the irritability score indicates the number of smokers who judged that the corresponding product was less irritant.

EXPERIMENT 6

The tobacco sheets prepared by the procedure set forth in Experiment 5 were measured for thickness, weight per unit area, wet-proof time, tensile strength, elongation and filling capacity. The results are shown in Table 4.

Table 4

| Sample \ Test item | Thickness (mm) | Weight per unit area ($g/m^2$) | Wet-proof time (hr.) | Tensile strength (g/mm) | Elongation (%) | Filling capacity (g/piece) |
|---|---|---|---|---|---|---|
| Control (1) | 0.084 | 88.4 | 0.25 | 181 | 3.9 | 1.305 |
| Control (2) | 0.086 | 89.2 | 0.24 | 180 | 3.7 | 1.307 |
| Control (3) | 0.083 | 88.2 | 0.25 | 182 | 3.9 | 1.304 |
| The product of this invention | 0.102 | 92.5 | Not less than 24 | 220 | 4.2 | 1.289 |

The procedures used for measuring the physical properties of sheets are as follows.

1. Thickness

The thickness of each sheet was measured under a load of 550 $g/cm^2$ on a thickness tester (for paper) manufactured by Toyo Seiki K. K.

2. Weight per unit area (1) Using a boring edge a disc 30 mm in diameter was cut out from 30 sheets.

(2) All the 30 mm. samples were weighed together on an automatic scale with a sensitivity of 5 mg.

(3) The weight per unit area was calculated by means of the following equation.

$$\text{Weight per unit area} = \frac{1{,}000{,}000 \times X}{3.14 \times (15)^2 \times 30}$$

where, X is the weight (g.) of 30 sheets

3. Wet-proof time (1) The sample was stored in a air conditioning room (20° C., 60% RH) for 2 days.

(2) The conditioned sheet was punched with a 30 mm(diameter) cutter edge.

(3) A dish was filled with 150 ml. of water of 25° C.and 5 sheets, 30 mm in diameter, were placed in the dish without overlapping. For each test specimen, the time that had elapsed before two or more slits (throughout the thickness) were produced was measured in minutes with a stop watch.

The dish was given a slight vibration every 1 minute.

4. Tensile strength (1) Equipment (1) Constant rate of elongation apparatus (Toyo Seiki K. K.) with an integrater.

(2) Sample cutter (3) Thickness gauge (2) Samples

From among moisture-controlled products (20° C., 60% RH), more or less representative specimens free of creases, cracks or slits were selected.

In longitudinal and transverse directions, 15 sheets each were cut to a size of 70 × 15 mm.

(3) Procedure

The test was performed in a chamber maintained at 20° C. and 60% RH.

Each specimen was loaded until it was torn apart.

(1) Pulling speed: 10 mm/min.

(2) The specimen was held taut in position. The effective length was 50 mm.

(3) The thickness of each specimen was previously measured.

(4) Computation and indication (1) Tensile load at break (g)

The load required to break the specimen was read on the meter.

(2) Tensile strength ($g/mm^2$)

The load required to break the specimen was expressed per unit area.

(3) Elongation (%)

The elongation at break was read on the meter and expressed as a percent of the length of the specimen.

5. Filling capacity (1) The samples taken (200 g.) were stored spread in an air conditioning chamber (20° C., 60% RH) for 2 days.

(2) The conditioned samples were transversely aligned and cut to a width of 10 mm with a cutting edge.

(3) The cut specimens were longitudinally aligned and shredded to a shredding width of 0.8 mm by means of a rotary shredder.

(4) The conditioned samples were stored spread in a conditioning chamber (20° C., 60% RH) for 2 days.

(5) The conditioned samples were weighed on an automatic scale with a sensitivity of 5 mg. and five sets of samples 15 g. each were taken.

(6) By means of a instrument for the measurement of filling capacity each 15 g. specimen was tested for its bulk density (g./3.135 $cm^3$) against a compression stress of 250 $g./cm^2$.

(7) For the remainder of specimen, their moisture contents were measured at two points with an Acme-type moisture tester (100° C., 1 hour).

(8) The mean average of values of filling capacity were calculated.

EXPERIMENT 7

With a cutting edge, 10 g. of a film of polysaccharide B obtained by the procedure set forth in Experiment 2 was cut to a width of 0.5 to 1 mm and a length of 5 to 15 mm. The filaments were blended with 10 g. of tobacco shreds for commercial cigarettes (Hi-Lite ® manufactured by Japan Tobacco & Salt Public Corporation) and, from this blend, cigarettes with a wrapping circumference of 25 mm and a length of 63 mm were fabricated using a manual test-cigarette wrapping equipment.

Then, by the same procedure as that described above for films, paper-wrapped cigarettes were fabricated from the reconstituted tobacco prepared using the polysaccharide B obtained in Experiment 5.

To each of these test cigarettes was attached an acetate filter with the same specifications as those of commercial cigarettes (Hi-Lite ®), i.e. a length of 17 mm, a size of monofilament of 4 deniers and a total denier number of 43,000, and the tar and nicotine contents of the smoke of each specimen were measured in the following manner.

A constant-flow automatic smoking machine was used to artificially smoke each cigarette specimen under the conditions: flow rate 17.5 ml./sec.; smoking time 2 sec./puff; puff frequency 1/min.; and distance of combustion 5.0 cm.

The crude tar was trapped with an aerosol trap filter (Cambridge Filter CM-113) and the moisture measured by the Karl-Fisher method was substracted from the value. The result was taken as the tar content. After the steam distillation of the crude tar, the nicotine in it was determined by the absorbance method (Scientific Papers of the Central Research Institute of the Japan Tobacco & Salt Public Corporation No. 105, P. 291, 1963).

The results are set forth in Table 5.

Table 5

| Sample | Length (mm) | Weight (mm/piece) | Tar in smoke (mg/piece) | Nicotine in smoke (mg/piece) |
|---|---|---|---|---|
| Test cigarettes with 30% polysaccharide B | 80 | 0.98±0.01 | 13–16 | 0.9–1.2 |
| Test cigarettes with 50% reconstituted tobacco based on polysaccharide B | 80 | 0.98±0.01 | 17 | 1.5 |
| Control: commercial cigarettes (Hi-Lite ®) | 80 | 0.98±0.01 | 21 | 1.8 |

It will be apparent from Table 5 that in the tar and nicotine contents of smokes, the test cigarettes based on polysaccharide B are significantly less than the commercial cigarettes (Hi-Lite ®).

EXAMPLE 1

A mixture of 750 g. of the tobacco fines from the tobacco manufacturing process and 250 g. of winnower debris was comminuted in a grinding machine to a mesh size of 100.

To this powder were added 50 g. of polysaccharide B and 300 ml. of water to prepare homogeneous wet granules.

The granules were fed to an extruder to obtain pellets about 3 mm in diameter and about 6 mm long. The pellets were directly passed down over a pair of rollers to prepare a reconstituted tobacco consisting of sheet fragments measuring 0.1 mm in thickness, 2–3 cm in width and 5–8 cm in length. The surface speed ratio of the rollers was 1:1.3, with the surface speed of the higher-speed roller being 60 m/min. The roll temperature was 85° C. The sheet scraped off with a doctor knife was in semidry condition. To adjust the moisture content of the sheet to about 12%, the sheet was fed on a wire-net conveyer through a moisture control room. The resulting product was superior to the comparable product based on the sodium salt of carboxymethylcellulose in all the physical properties mentioned in Experiment 6.

EXAMPLE 2

10 kg. of low-grade smoking flue-cured tobacco were crushed in a crushing machine to a size of about 10 $mm^2$ and, then, milled to a powder in a mixer. To this powder was added 3 kg. of polysaccharide B, followed by thorough mixing to obtain a mixed powder. To this mixed powder were added 0.55 kg. of propylene glycol, 0.65 kg. of sucrose and 26 l. of water and the resulting homogeneous slurry was coated on a stainless steel belt which was, then, passed over a heater, whereupon the slurry became a gel. The gel was then dried to obtain a sheet tobacco with a thickness of 0.15 mm, a weight per unit area of 58 $g/m^2$ and a moisture content of 12%.

This sheet was superior to the comparable prior-art product based on hydroxyethylcellulose instead of polysaccharide B in the physical properties mentioned in Experiment 6, as well as in smoking characteristics.

EXAMPLE 3

10 kg. of a mixture of fines, dust and winnower debris formed in the course of production in a tobacco plant was methanically milled to a powder, to which 3 kg. of purified α-cellulose and 3 kg. of polysaccharide B were added. The mixture was thoroughly blended to prepare a mixed powder. To this mixed powder were added 0.5 kg. of propylene glycol, 0.5 kg. of sucrose and 13 l. of water, followed by thorough mixing to prepare a homogeneous wet granular product. This product was passed down over the rollers of a heat-rolling equipment maintained at a roll-surface temperature of 150° C. to obtain a thin film. The film thus formed was detached with a doctor knife and transferred on a wirenet conveyor through a drying chamber and, then, a conditioning chamber to prepare a tobacco sheet with a moisture content of 15%.

This sheet product was superior to the comparable sheet based on locust bean gum instead of polysaccharide B in smoking characteristics and in the physical properties mentioned in Experiment 6.

EXAMPLE 4

To a solvent mixture of 4 l. of demineralized water and 100 g. of glycerin was added 4 g. of calcium carbonate, followed by stirring. To this were added 1 kg. of tobacco dust with a particle size of 50 to 200μ and 200 g. of polysaccharide B and the resulting mixture was kneaded to prepare a homogeneous mixture. This slurry was coated on a stainless steel belt to a thickness of about 2 mm. The slurry coating was caused to undergo gelation at 90° C. and, then, dried in a hot current of air to a moisture content of 10–15%.

The stainless steel belt was then further driven to transverse a cooling chamber, whereby the sheet was cooled to 5°-10° C. The sheet was detached from the belt with a doctor knife. The tensile strength of the resulting product sheet was comparable to that of ordinary tobacco leaves, it being difficult to disintegrate the sheet by crumpling in the palm. It also had excellent smoking characteristics.

EXAMPLE 5

The procedure of Example 4 was repeated, except that 1 kg. of tobacco dust was replaced with 200 g. of needle leaf tree pulp and 800 g. of tobacco dust to prepare a sheet product. The tensile strength of this product was almost comparable to that of ordinary leaf tobacco, it being difficult to disintegrate by crumpling in the palm.

EXAMPLE 6

To 35 l. of water was added 2 kg. of polysaccharide B and the mixture was stirred well to the consistency of a slurry. To the slurry was poured 65 l. of hot water to prepare a suspension of 60°-70° C. The suspension was coated on a stainless steel belt at room temperature to a small thickness and allowed to undergo gelation in situ. Over a continuous web of the wet polysaccharide B gel on the stainless steel belt, 40 g./m$^2$ of the tobacco dust described in Example 2 was dusted. Then, on the dusted surface was super-imposed a separate wet polysaccharide B gel obtained in the same manner as Example 2, followed by drying and heat-sealing. The procedure provided about 7 kg. of a tobacco sheet with a moisture content of 12%. This sheet was superior to the product based on 1 kg. of sodium alginate and 1 kg. of glyoxal instead of polysaccharide B in smoking characteristics and in the physical properties mentioned in Experiment 6.

EXAMPLE 7

In 100 ml. of 1.4% aqueous ammonia was dissolved 4 g. of polysaccharide A and the solution was promptly coated on a place where it was allowed to undergo gelation and, then, dried at a temperature not exceeding 60° C. When the moisture content of the film had dropped to 30% or less, 4 g. of tobacco dust was evenly deposited over the surface of this semi-wet film. Then, the composition was heat-compressed at 150° C. for 5 minutes to obtain a tobacco sheet. This product had excellent smoking characteristics.

EXAMPLE 8

500 ml. of a 2% aqueous suspension of polysaccharide C was coated on a stainless steel belt to a thickness of about 1 mm. Then, 100 g. of tobacco dust containing 3% of powdery polysaccharide C was dusted evenly over the polysaccharide C slurry coating on the stainless steel belt, followed by drying. The resulting tobacco sheet had exceptionally satisfactory smoking characteristics.

EXAMPLE 9

100 g. of shredded tobacco for commercial cigarettes (Hi-Lite®) was sprayed with 5 ml. of distilled water and, then, mixed with 2 g. of polysaccharide B powder. The resulting mixture was placed in a dryer at 100° C. for 5 minutes and, after spontaneous cooling, wrapped in paper on a test cigarette-wrapping equipment to a length of 70 mm and a circumference of 25.7 mm. The resulting cigarettes were superior in firmness to the commercial cigarettes free of the polysaccharide. These cigarettes also had excellent smoking characteristics.

EXAMPLE 10

7.5 kg. portions of tobacco shreds for cigarettes were sprayed with 3 kg. of water and 3 kg. of a 2% suspension of polysaccharide B, respectively, whereby the tobacco shreds were impregnated with the additives. These treated tobacco shreds were dried by heated air flow in a drying chamber to adjust their moisture content.

The resulting percent increases in bulk are as follows.

| | Amount required for 10 cigarettes | % Increase |
|---|---|---|
| Untreated shreds | 90 ml. | — |
| Shreds treated with water | 98 ml. | +9% |
| Shreds treated with polysaccharide B | 117 ml. | +22% |

The cigarettes obtained by wrapping the tobacco shreds thus treated with polysaccharide B to a length of 76 mm and a circumference of 25.7 mm were superior to the cigarettes similarly fabricated from untreated shreds and water-treated shreds, respectively, in terms of firmness and smoking characteristics.

EXAMPLE 11

To a tobacco source composed of 1 kg. of sorbitol, 5 kg. of sucrose, 1 l. of tobacco extract (10% concentration), 2 kg. of 1,3-butylene glycol, 0.5 kg. of water-soluble flavor and 100 l. of water was added 3 kg. of polysaccharide B and the resulting mixture was used to treat tobacco leaves at the rate of addition of 2-3% relative to the leaves in an atmosphere of 100° C. for 5 minutes in a casing step of the tobacco manufacturing process. After spontaneous cooling, the tobacco was shredded, dried and thereafter subjected to a flavoring step, a conditioning step, etc. The tobacco shreds thus treated were fabricated into cigarettes with a length of 70 mm and a circumference of 25.7 mm.

The resulting cigarettes were lower in specific gravity than the comparable products free of polysaccharide B, displaying excellent smoking characteristics. Moreover, the tobacco of this example yielded a less amount of debris or rejects in the shredding operation, giving an improvement in yield.

EXAMPLE 12

To 1 kg. of a tobacco leaf composition consisting of 30% of flue-cured tobacco, 10% of burley tobacco, 30% of Japanese domestic tobacco, 18% of stems and 12% of rolled sheets was added a hot solution prepared as follows. Thus 30 g. of a formulated flavorant made up of 30% of glycerin, 22% of sucrose, 10% of sorbitol, 5% of licorice extract, 3% of fruit extract and 30% of polysaccharide B was diluted with hot water to prepare a 20% solution.

The above procedure provided a homogeneous wet powdery product. This powder was processed in the same manner as Example 1 to obtain a tobacco product. This product displayed improvements in smoking characteristics as well as in the physical properties mentioned in Experiment 6.

EXAMPLE 13

With the addition of 50 ml. of water, 100 g. of a blend of 60% of tobacco dust, 20% of purified cellulose and 20% of polysaccharide B was mixed well in a mixer. The mixture was extruded from a manual screen-type extruder (6 r.p.m.) equipped with a plate having 8 mm. orifices and the extrudate was cut with the accessory cutter to a length of 7 mm.

The procedure provided a molded product with a moisture content of 38%. The temperature of the composition at the mixing and molding step was 20°-30° C.

Then, the molded product was maintained under indirect heating with steam at 80° C. for 10 minutes, after which it was dried in a dryer with shelfs at an air-current temperature of 90° C. for 2 hours to prepare a tobacco molding with a moisture content of 9%. This product had excellent smoking characteristics.

EXAMPLE 14

The wrapper (Nambu leaves, etc.) for forming the exterior layer of a cigar was coated with 50 g./square meter of a 2% suspension of polysaccharide B and dried in a current of air to a moisture content of about 13%. The cigars fabricated using this product were superior to the conventional cigars in water-retention property, being less sticky to the lips and having excellent smoking characteristics.

EXAMPLE 15

To 20 g. of the polysaccharide A were added 50 g. of powdery dolomite ($CaMg(CO_3)_2$) and 30 g. of carboxymethylcellulose, followed by mixing sufficiently. To this mixture was added 350 ml. of water and the resulting mixture was muddled to prepare a slurry. The slurry was spreaded on a glass plate and, then, dried at 80° C. to prepare a sheet-like product with a weight per unit area of about 100 g/m$^2$. This sheet was cut to a width of about 0.8 mm and a length of about 10 mm, to which were, then, added 1 ml. of tobacco extract (10% concentration) and 0.3 ml. of licorice extract to prepare tobacco substitute product.

On the other hand, the above-mentioned procedure was repeated, except employing 20 g. of carboxymethylcellulose in place of 20 g. of the polysaccharide A, to prepare tobacco substitute product.

The former was superior to the latter in the physical properties mentioned in Experiment 6, as well as in reducing undesirable odor arising from a smoking paper, irritant odor and specific odor or taste.

To tobacco shreds for the commercial cigarettes (Hi-Lite®) was added the aforementioned thredded tobacco substitute product containing the polysaccharide A at the rate of 20 percent by weight. For an experimental use, the resulting mixture was prepared into cigarettes.

The cigarettes were mild in smoking flavor and taste and were respectively reduced at the rate of about 10 percent in tar content and about 15 percent in nicotine content of smoke in comparison with the commercial cigarettes (Hi-Lite®).

EXAMPLE 16

To 50 g. of the polysaccharide A was mixed with 50 g. of powdery dolomite.

To this mixture was added 350 ml. of water and the resulting mixture was muddled to prepare a slurry. The slurry was spreaded on a chromium plated brass plate and, then, dried at 80° C. to prepare a sheet-like product with a weight per unit area of about 100 g/m$^2$. This sheet was cut into a width of about 0.8 mm and a length of about 10 mm, to which are then added tobacco extract (10% concentration) and licorice extract of the same volume as example 15 to prepare tobacco substitute product, which was far superior to the tobacco substitute product, prepared in the Example 15, comprising dolomite and carboxymethylcellulose in the physical properties mentioned in Experiment 6 as well as in reducing undesirable odor arising from a smoking paper, irritant odor and specific odor or taste.

EXAMPLE 17

Fifty grams of polysaccharide A was well mixed with 50 g. of powdery dolomite, followed by addition of 350 ml. of water to make the resulting mixture a slurry. The slurry was spreaded on a chromium-plated brass board, and, then dried at 80° C. to prepare a sheet-like composition weighing about 100 g/m$^2$. This sheet was cut into pieces with a width of about 0.8 mm and a length of about 10 mm. To these pieces was added homogeneously a 50% ethyl alcohol solution containing 1.0 g. of tobacco extract, 0.3 g. of licorice extract and 0.3 g. of St. John's Bread extract (manufactured and sold by Ogawa Koryo Co., Ltd.), the resulting mixture being used as a good tobacco substitute.

On the other hand, to 50 g. of powdery dolomite was added 50 g. of powdery carboxymethylcellulose in place of polysaccharide A and the mixture was processed and flavored in the same manner as above to prepare a control product.

The tobacco substitute was found to be superior to the control product in tensile strength, elongation and wet-proof qualities as shown in Table 6 and in smoking characteristics as shown in Table 7.

Table 6

| Sample \ Test Item | Thickness (mm) | Weight per unit area (g/m$^2$) | Wet-Proof time (min.) | Tensile strength (g/mm) | Elongation (%) |
|---|---|---|---|---|---|
| Control | 0.15 | 103.0 | 1 | 127 | 2.8 |
| Product of this invention | 0.13 | 99.8 | 45 | 248 | 3.5 |

(The same measure methods as in Experiment 6 were employed.)

Table 7

| Sample \ Smoking characteristics | Flavor | Taste | Irritability |
|---|---|---|---|
| Control | 8 | 6 | 3 |
| Product of this invention | 12 | 14 | 17 |

Each of these samples was tested twice by 10 panelists. The scores on flavor and taste, respectively, mean the number of smokers who judged that the corresponding product was better; the irritability score indicates the number of smokers who judged that the corresponding product was less irritant.

EXAMPLE 18

Thirty grams of polysaccharide A was well mixed with 30 g. of powdery ferric oxide ($Fe_2O_3$) and 40 g. of powdery carboxymethylcellulose, followed by addition of 400 ml. of water to make the resulting mixture a slurry. The slurry was spreaded on a glass plate, and, then dried at 80° C to prepare a sheet-like composition weighing of about 100 g./m$^2$. This sheet was cut into pieces with a width of about 0.8 mm and a length of about 10 mm. To these pieces was added homogeneously 50% ethyl alcohol solution containing 0.5 g. of tobacco extract and 0.5 g. of cocoa extract, the resulting mixture being used as a good tobacco substitute.

On the other hand, 30 g. of powdery ferric oxide and 70 g. of powdery carboxymethylcellulose are mixed and the mixture was processed and flavored in the same manner as above solution as above to prepare a control product.

The tobacco substitute product was superior to the control product in smoking characteristics as shown in Table 8.

Table 8

| Sample | Smoking characteristics Flavor | Taste | Irritability |
|---|---|---|---|
| Control | 7 | 9 | 4 |
| Product of this invention | 13 | 11 | 16 |

(The same test method as in Example 17 was employed.)

EXAMPLE 19

Sixty grams of polysaccharide A was well mixed with 40 g. of powdery bentonite ($Al_2O_3.4SiO_2.H_2O$), followed by addition of 350 ml. of water to make the resulting mixture a slurry. The slurry was spreaded on a chromium-plated brass board, and, then dried at 80° C to prepare a sheet-like composition weighing about 100 g/m$^2$. This sheet was cut into pieces with a width of about 0.8 mm and a length of about 10 mm. To these pieces was added homogeneously a 50% ethyl alcohol solution containing 1.0 g. of tobacco extract, 0.3 g. of licorice extract and 0.3 g. of St. John's Bread extract, the resulting mixture being used as a good tobacco substitute.

On the other hand, to 40 g. of powdery bentonite was added 60 g. of powdery carboxymethylcellulose and the mixture was processed and flavored in the same manner as above to prepare a control product.

The tobacco substitute was superior to the control product in smoking characteristics.

EXAMPLE 20

To 60 g. of refined and screened (opening 1 mm pass) pulp (Needle fold bleached kraft pulp) were added 10 g. of colloidal calcium carbonate and 30 g. of polysaccharide A, followed by mixing. To this mixture was added 500 ml. of water and the resulting mixture was muddled to prepare a slurry. The slurry was spreaded on a chromium plated brass plate and, then, dried at 80° C to prepare a sheet-like composition weighing about 100 g./m$^2$.

To this sheet was added homogeneously a 50% ethyl alcohol solution containing 1.0 g. of tobacco extract, 0.5 g. of absolute honey wax and 0.2 g. of cocoa extract to prepare a sheet-like tobacco substitute.

On the other hand, 60 g. of the above mentioned pulp were mixed with 10 g. of colloidal calcium carbonate and 30 g. of carboxymethylcellulose. The resulting mixture was processed and flavored in the same manner as above to prepare a sheet-like tobacco substitute product (control).

The sheet-like tobacco substitute product was superior to the control product in wet-proof qualities and smoking characteristics.

EXAMPLE 21

60 g. of refined and screened (opening 1 mm pass) pulp (N.B.K.P) was impregnated with about 4 g. of a 6% aqueous ammonium sulfamate solution and was heated at 200° C for about 3 hours to prepare burnt black pulp powder.

To this black powder were added 10 g. of colloidal calcium carbonate, 20 g. of carboxymethylcellulose and 40 g. of polysaccharide A, followed by mixing. To this mixture was added 400 ml. of water and the resulting mixture was muddled to prepare a slurry, followed by adding 1.5 g. of tobacco extract, 0.5 g. of dear tang extract (manufactured by Takasago. Koryo Ltd., Japan), 1.0 g. of fig extract (manufactured by Hogyoku Koryo Ltd., Japan) and 0.3 g. of licorice extract. The slurry was spreaded on a glass plate and, then, dried at about 60° C to prepare a sheet-like product weighing about 100 g/m$^2$.

On the other hand, to the treated powdery pulp mentioned above were 10 g. of colloidal calcium carbonate and 60 g. of carboxymethylcellulose. The resulting mixture was flavored and processed in the same manner as above to prepare a product (control).

The sheet-like product was superior to the control in smoking characteristics as shown in Table 9.

Table 9

| Sample | Smoking characteristics Flavor | Taste | Irritability |
|---|---|---|---|
| Control | 4 | 3 | 8 |
| Product of this invention | 16 | 17 | 12 |

(The same test method as in Example 17 was employed).

EXAMPLE 22

Twenty grams of powdery activated carbon for decoloration was well mixed with 30 g. of polysaccharide B and 50 g. of powdery carboxymethylcellulose, followed by addition of 450 ml. of water to make the resulting mixture a slurry. The slurry was spreaded on a glass plate, and, then dried at 80° C to prepare a sheet-like composition weighing about 100 g/m$^2$. This sheet was cut into pieces with a width of about 0.8 mm. and a length of about 10 mm. To these pieces was added homogeneously a 50% ethyl alcohol solution containing 1.0 g. of tobacco extract, 0.3 g. of licorice extract and 0.3 g. of St. John's Bread extract, the resulting mixture being used as a good tobacco substitute.

On the other hand, to 20 g. of powdery activated carbon for decoloration was added 80 g. of powdery carboxymethylcellulose and the mixture was processed and flavored in the same manner as above to prepare product (control).

The tobacco substitute was superior to the control product in smoking characteristics as shown in Table 10.

Table 10

| Sample | Smoking characteristics Flavor | Taste | Irritability |
|---|---|---|---|
| Control | 3 | 3 | 5 |
| Product of this | | | |

Table 10-continued

| Sample | Smoking characteristics Flavor | Taste | Irritability |
|---|---|---|---|
| invention | 17 | 17 | 15 |

(The same test method as in Example 17 was employed).

EXAMPLE 23

To 30 g. of powdery dolomite were sufficiently mixed with 20 g. of ground residue obtained by evaporating 3% dispersion of polysaccharide A at 80° C in an air bath to dryness, 20 g. of powdery polysaccharide A and 30 g. of powdery carboxymethylcellulose. To this mixture was 500 ml. of water and the resulting mixture was muddled to prepare a slurry. The slurry was spreaded on a glass plate and, then, dried at 80° C to prepare a sheet-like product with a weight per unit area of about 100 g./m$^2$. This sheet was cut into pieces with a width of about 0.8 mm and a length of about 10 mm, to which was homogeneously added 50% ethyl alcohol containing 1.0 g. of tobacco extract, 0.3 g. of licorice extract and 0.3 g. of St. John's Bread extract to prepare tobacco substitute product. On the other hand, 30 g. of powdery dolomite was mixed with 70 g. of carboxymethylcellulose and the mixture was processed and flavored in the same manner as above to prepare a control product.

The tobacco substitute product was superior to the control product in smoking characteristics as shown in Table 11.

Table 11

| Sample | Smoking characteristics Flavor | Taste | Irritability |
|---|---|---|---|
| Control | 8 | 7 | 5 |
| Product of this invention | 12 | 13 | 15 |

(The same test method as in Example 17 was employed)

EXAMPLE 24

20 g. of powdery activated carbon for decoloration was sufficiently mixed with 50 g. of powdery carboxymethylcellulose. To this mixture was added 300 ml. of water and the resulting mixture was muddled to prepare a slurry, which was sufficiently mixed with a mixture comprising 20 g. of polysaccharide A and 300 ml. of 1% aqueous ammonia.

The resulting slurry was spreaded on a glass plate and, then dried at 100° C. to prepare a sheet-like product with about 100 g./m$^2$. This sheet was cut into a width of about 0.8 mm and a length of about 10 mm, to which was, then, homogeneously added 50% ethyl alcohol solution containing 1.0 g. of tobacco extract, 0.3 g. of licorice extract and 0.3 g. of St. John's Bread extract to prepare a tobacco substitute.

On the other hand, to 20 g. of powdery activated carbon for decoloration was added 80 g. of powdery carboxymethylcellulose and the mixture was processed and flavored in the same manner as above to prepare a control product.

The tobacco substitute showed better smoking characteristics than the control product as shown in Table 12.

Table 12

| Sample | Smoking characteristics Flavor | Taste | Irritability |
|---|---|---|---|
| Control | 7 | 7 | 3 |
| Product of this invention | 13 | 13 | 17 |

(The same test method as in Example 17 was employed)

EXAMPLE 25

To 500 kg. of culture broth, in which concentration of polysaccharide B was about 4%, obtained by cultivating the mutant NTK-u (IFO 13140, ATCC 21680) of *Alcaligenes faecalis var. myxogenes* 10C3K was poured 500 l. of hot water and stirred vigorously to prepare a suspension of 60-70° C. This suspension was thinly coated on a stainless steel belt at room temperature and allowed to undergo gelation in situ. Over a continuous web of the wet polysaccharide B gel on the stainless steel belt, 40 g./m$^2$ of refined and screened (opening 1 mm pass) pulp (obtained by treating 60 g. of N.B.K.P. impregnated with about 4 g. of a 6% aqueous ammonium sulfamate solution at 200° C. for about 3 hours) was dusted and the obtained product was put in a heater (90° C.), allowed to gelatinize and, then, dried to prepare a sheet-like product.

EXAMPLE 26

100 kg. of culture broth, in which concentration of polysaccharide C was about 2%, obtained by cultivating Agrobacterium radiobacter (IFO 13127, ATCC 6466) was concentrated by a centrifuge (5000 G) to prepare 450 kg. of concentrated solution containing polysaccharide C of about 4%.

To the concentrated solution were added 20 kg. of powdery activated carbon for decoloration and 50 kg. of powdery carboxymethylcellulose, followed by mixing sufficiently, to prepare a slurry. The slurry was spreaded on a stainless steel belt, gelatinized at 90° C. and, then, dried to prepare a sheet-like product, to which was homogeneously added a 50% ethyl alcohol containing 1.0 kg. of tobacco extract, 0.5 kg. of absolute honey wax and 0.2 kg. of cocoa extract to a flavored sheet-like product.

EXAMPLE 27

A 4% culture broth of polysaccharide A obtained by cultivating *Alcaligenes faecalis var. myxogenes* 10C3K was concentrated by a centrifuge (5000 G) to prepare 450 kg. of concentrated solution (solids about 7–8%), to which were added 20 kg. of powdery activated carbon for decoloration and 50 kg. of powdery carboxymethylcellulose, followed by mixing sufficiently, to prepare a slurry. The slurry was extruded from an extruder to prepare pellet-like products, which was passed down over a roller at a rollsurface temperature of 150° C.

Thus-obtained sheet-like fragments pieces were put in a fluid-type dryer and sprayed with a 50% ethanol solution containing 1.0 kg. of tobacco extract, 0.3 kg. of licorice extract and 0.3 kg. of St. John's Bread extract to prepare tobacco substitute.

EXAMPLE 28

To 1500 l. of culture broth, in which concentration of polysaccharide B was about 4%, obtained by cultivating the mutant NTK-u (IFO 13140, ATCC 21680) of *Alcaligenes faecalis var. myxogenes* 10G3K was added 1500 l. of a 4% aqueous sodium hydroxide solution to dissolve polysaccharide B and then, from the resulting solution the cells was removed by a centrifuge and, then, polysaccharide B was separated by neutralizing with a 4N-HCl solution to prepare 3280 l. of 1.75% suspension of polysaccharide B (yield: 95.5%). As to the suspension, concentration by using centrifuge and dilution by adding water were repeated to remove soluble inorganic salts. The suspension was coated on a stainless steel belt, on which were, then, coated the mixture comprising 100 kg. of refined and screened (opening 1 mm pass) pulp (N.B.K.P) and 100 kg. of the above-mentioned suspension, followed by drying to prepare a sheet-like product.

EXAMPLE 29

3280 l. of suspension of polysaccharide B removed soluble inorganic salts in the same manner as Example 28 was concentrated with a centrifuge (8000 G) to prepare 900 kg. of 6.1% concentrated suspension of polysaccharide B (yield 95.8%). To 400 kg. of the concentrated suspension was sufficiently mixed with 30 kg. of powdery ferric oxide ($Fe_2O_3$) and 40 kg. of powdery carboxymethylcellulose to prepare a slurry. The slurry was spreaded on a stainless steel belt, allowed to gelatinize at 90° C. and then dried to prepare a sheet-like product. To the sheet-like product was added a 50% ethanol solution containing 1 kg. of tobacco extract and 1 kg. of cocoa extract to prepare a flavored sheet-like product.

EXAMPLE 30

To 500 kg. of the remaining concentrated suspension of polysaccharide B employed in Example 29 were added 30 kg. of powdery Bukuryo (Poria cocos) and the burnt black pulp powder obtained by treating 60 kg. of refined and screened (opening 1 mm pass) pulp impregnated with 4 kg. of a 6% aqueous ammonium sulfamate solution at 200° C. for about 3 hours, followed by mixing sufficiently to prepare a slurry. To the slurry were added 1.5 kg. of tobacco extract, 0.5 kg. of dear tang extract, 1.0 kg. of fig extract and 0.3 kg. of licorice extract. The resulting slurry was spreaded on a stainless steel belt and, then, dried at about 60° C to a sheet-like product. The sheet-like product had no undesirable odor arising from a smoking paper and excellent smoking characteristics.

EXAMPLE 31

To 100 l. of a 4% culture broth of polysaccharide A obtained by cultivating *Alcaligenes faecalis var. myxogenes* 10C3K was added 100 l. of a 4% aqueous sodium hydroxide solution to dissolve polysaccharide A.

The solution was added dropwise through a nozzle of 1.5 mm. in diameter into 2N-HCl solution to prepare granules of polysaccharide A.

The granules were taken out and washed with water and then were passed down over a roller at a rollsurface temperature of 150° C. to prepare sheet-like pieces. These sheet-like pieces were put in a fluid-type dryer and sprayed with flavorants. Thus-obtained sheet-like pieces were mild in smoking aroma and taste and were suitable for smoking.

What we claim is:

1. A process for producing a smoking tobacco product, which comprises incorporating a thermo-gelable β-1,3-glucan-type polysaccharide into a smoking material.

2. The process according to claim 1, wherein the thermo-gelable β-1,3-glucan-type polysaccharide to be incorporated is a crude preparation containing at least about 80 weight percent of the polysaccharide on dry basis.

3. The process according to claim 1, wherein the amount of the thermo-gelable β-1,3-glucan-type polysaccharide to be incorporated is about 0.05 to about 25 percent by weight based on the weight of the smoking material.

4. The process according to claim 1, wherein the incorporation is made by spraying or coating a dispersion of about 0.5 to about 10 percent by weight of the thermogelable β-1,3-glucan-type polysaccharide onto the smoking material.

5. The process according to claim 1, wherein the incorporation is made by the addition of a gelation product made from the thermo-gelable β-1,3-glucan-type polysaccharide to the smoking material.

6. The process according to claim 1, wherein the incorporation is made by the addition of a sheet made from the thermo-gelable β-1,3-glucan-type polysaccharide to the smoking material.

7. The process according to claim 1, wherein the incorporation is made by the addition of shreds of a sheet made from the thermo-gelable β-1,3-glucan-type polysaccharide to the smoking material.

8. The process according to claim 1, wherein the incorporation is made by spraying or coating a dispersion of about 0.5 to 10 percent by weight of the thermo-gelable β-1,3-glucan-type polysaccharide onto the wrapper of tobacco product.

9. A process for producing a smoking tobacco substitute, which comprises incorporating burning regulator and a thermo-gelable β-1,3-glucan-type polysaccharide in a smoking material for a smoking tobacco substitute.

10. The process according to claim 9, wherein the thermo-gelable β-1,3-glucan-type polysaccharide to be incorporated is a crude preparation containing at least about 80 weight percent of the polysaccharide on dry basis.

11. The process according to claim 9, wherein the incorporating ratio between the burning regulator and the combination of the smoking material for tobacco substitute and the thermo-gelable β-1,3-glucan-type polysaccharide is, in the respective weight ratio, 90:10 to 10:90.

12. The process according to claim 9, wherein the amount of the thermo-gelable β-1,3-glucan-type polysaccharide to be incorporated is from 30 to 100 percent by weight based on the weight of smoking material for tobacco substitute.

13. The process according to claim 12, wherein the amount of the thermo-gelable β-1,3-glucan-type polysaccharide to be incorporated is 100 percent by weight based on the weight of smoking material for tobacco substitute.

14. The process according to claim 9, wherein the incorporation is made by the addition of a gelation product made from the thermo-gelable β-1,3-glucan-type polysaccharide to the smoking material for tobacco substitute.

15. The process according to claim 9, wherein the incorporation is made by the addition of a sheet made from the thermo-gelable β-1,3-glucan-type polysaccharide to the smoking material for tobacco substitute.

16. The process according to claim 15, wherein the incorporation is made by the addition of shreds of the sheet made from the thermo-gelable β-1,3-glucan-type polysaccharide to the smoking material for tobacco substitute.

17. The process according to claim 9, wherein the incorporation is made by the addition of a thread made from the thermo-gelable β-1,3-glucan-type polysaccharide to the smoking material for tobacco substitute.

18. The process according to claim 17, wherein the incorporation is made by the addition of shreds of the thread made from the thermo-gelable β-1,3-glucan-type polysaccharide to the smoking material for tobacco substitute.

19. A tobacco product, which comprises smoking material and a thermo-gelable β-1,3-glucan-type polysaccharide.

20. The tobacco product according to claim 19, wherein the thermo-gelable β-1,3-glucan-type polysaccharide is produced by microorganisms belonging to the genus *Alcaligenes,* the genus *Agrobacterium* or *Poria cocos.*

21. The tobacco product according to claim 20, wherein the microorganism is *Alcaligenes faecalis.*

22. The tobacco product according to claim 20, wherein the microorganism is *Agrobacterium radiobacter.*

23. The tobacco product according to claim 20, wherein the microorganism is *Poria cocos.*

24. The tobacco product according to claim 19, wherein the thermo-gelable β-1,3-glucan-type polysaccharide is a crude preparation containing at least about 80 weight percent of the polysaccharide on dry basis.

25. The tobacco product according to claim 19, wherein the amount of the thermo-gelable β-1,3-glucan-type polysaccharide is about 0.05 to about 25 percent by weight based on the weight of the smoking material.

26. The tobacco product according to claim 19, wherein the thermo-gelable β-1,3-glucan-type polysaccharide is in the form of a dispersion of about 0.5 to about 10 percent by weight.

27. The tobacco product according to claim 26, wherein a incorporation of the dispersion is made by spraying or coating.

28. The tobacco product according to claim 19, wherein the thermo-gelable β-1,3-glucan-type polysaccharide is in the form of a gelation product.

29. The tobacco product according to claim 28, wherein the gelation product is a sheet.

30. The tobacco product according to claim 29, wherein the sheet is shreaded.

31. The tobacco product according to claim 19, wherein the thermo-gelable β-1,3-glucan-type polysaccharide is in the form of a gelation product containing flavorants of about 0.1 to about 10 percent based on the weight of the gelation product.

32. The tobacco product according to claim 19, wherein the tobacco product is a tobacco having improved smoking characteristics comprising smoking material and about 0.1 to about 10 percent by weight of the smoking material of the thermo-gelable β-1,3-glucan-type polysaccharide.

33. The tobacco product according to claim 19, wherein the tobacco product is a tobacco having improved physical properties comprising smoking material and about 0.5 to about 15 percent by weight based on the weight of the smoking material of the thermo-gelable β-1,3-glucan-type polysaccharide.

34. The tobacco product according to claim 19, wherein the tobacco product is a tobacco having improved binding action and properties comprising smoking material and about 1 to about 30 percent by weight based on the weight of the smoking material of the thermo-gelable β-1,3-glucan-type polysaccharide.

35. The tobacco product according to claim 19, wherein the tobacco product is a tobacco product incorporated in the surface of tobacco product with a dispersion of about 0.5 to about 10 percent by weight of the thermo-gelable β-1,3-glucan-type polysaccharide.

36. The tobacco product according to claim 35, wherein the amount of the thermo-gelable β-1,3-glucan-type polysaccharide to be incorporated is about 30 to about 200 grams per square meter of the polysaccharide dispersion of about 0.5 to about 10 percent by weight.

37. The tobacco product according to claim 35, wherein the incorporation is made by spraying or coating.

38. A tobacco substitute, which comprises burning regulator, a thermo-gelable β-1,3-glucan-type polysaccharide and smoking material for tobacco substitute.

39. The tobacco substitute according to claim 38, wherein the thermo-gelable β-1,3-glucan-type polysaccharide is produced by microorganisms belonging to the genus *Alcaligenes,* the genus *Agrobacterium* or *Poria cocos.*

40. The tobacco substitute according to claim 39, wherein the microorganism is *Alcaligenes faecalis.*

41. The tobacco substitute according to claim 39, wherein the microorganism is *Agrobacterium radiobacter.*

42. The tobacco substitute according to claim 39, wherein the microorganism is *Poria cocos.*

43. The tobacco substitute according to claim 38, wherein the thermo-gelable β-1,3-glucan-type polysaccharide is a crude preparation containing at least about 80 weight percent of the polysaccharide on dry basis.

44. The tobacco substitute according to claim 38, wherein the amount of the thermo-gelable β-1,3-glucan-type polysaccharide is from 30 to 100 percent by weight based on the weight of smoking material for tobacco substitute.

45. The tobacco substitute according to claim 44, wherein the amount of the thermo-gelable β-1,3-glucan-type polysaccharide is 100 percent by weight based on the weight of smoking material for tobacco substitute.

46. The tobacco substitute according to claim 38, wherein the incorporating ratio between the burning regulator and the combination of the smoking material for tobacco substitute and the thermo-gelable β-1,3-glucan-type polysaccharide is, in the respective weight ratio, 90:10 to 10:90.

47. The tobacco substitute according to claim 46, wherein the incorporating ratio between the burning regulator and the combination of the smoking material for tobacco substitute, and the thermo-gelable β-1,3-glucan-type polysaccharide is, in the respective weight ratio, 70:30 to 30:70.

48. The tobacco substitute according to claim 38, wherein the thermo-gelable β-1,3-glucan-type polysaccharide is in the form of a gelation product.

49. The tobacco substitute according to claim 48, wherein the gelation product is a sheet.

50. The tobacco substitute according to claim 49, wherein the sheet is shreaded.

51. The tobacco substitute according to claim 48, wherein the gelation product is a thread.

52. The tobacco substitute according to claim 51, wherein the thread is threaded.

* * * * *

UNITED STATES PATENT AND TRADEMARK OFFICE

CERTIFICATE OF CORRECTION

PATENT NO. : 4,109,663

DATED : August 29, 1978

INVENTOR(S) : Kazuo Maeda, Katuichi Nogushi, Masuo Kawabata, Shigehiko Sato and Yukio Sato It is certified that error appears in the above-identified patent and that said Letters Patent are hereby corrected as shown below:

Page 1, Assignee line [73] should read:

-- [73] Assignee: Takeda Chemical Industries, Ltd., Japan and The Japan Tobacco & Salt Public Corporation, Japan. --.

Signed and Sealed this

Eighth Day of May 1979

[SEAL]

*Attest:*

RUTH C. MASON
*Attesting Officer*

DONALD W. BANNER
*Commissioner of Patents and Trademarks*